US005085591A

United States Patent [19]

Warren, Sr. et al.

[11] Patent Number: 5,085,591

[45] Date of Patent: Feb. 4, 1992

[54] SAFETY PLUG WITH PRONG LOCKS

[76] Inventors: Charles C. Warren, Sr.; Shirley J. Warren, both of P.O. Box 4725, Estes Park, Colo. 80517

[21] Appl. No.: 575,988

[22] Filed: Nov. 5, 1990

[51] Int. Cl.[5] ..... H01R 13/44

[52] U.S. Cl. ..... 439/131; 439/172

[58] Field of Search ..... 439/131, 166-177, 439/103, 133, 134

[56] References Cited

U.S. PATENT DOCUMENTS 2,490,580 12/1949 Colla, Jr. ..... 439/155
2,538,296 1/1951 Crocker ..... 439/172
3,926,494 12/1975 Maillaro ..... 439/131
4,637,965 1/1987 Davis ..... 429/178
4,649,332 3/1987 Bell ..... 439/180

FOREIGN PATENT DOCUMENTS 508882 7/1939 United Kingdom ..... 439/172

*Primary Examiner*—Neil Abrams
*Attorney, Agent, or Firm*—Dean P. Edmundson

[57] ABSTRACT

An electrical plug for the end of an electrical power cord. The plug includes prongs which are movable between retracted and extended positions. The prongs can be locked in the retracted and extended positions, as desired. When the prongs are locked in the retracted position, small children are prevented from attempting to connect the power cord to an electrical outlet.

6 Claims, 1 Drawing Sheet

SAFETY PLUG WITH PRONG LOCKS

FIELD OF THE INVENTION

This invention relates to electrical plugs at the end of an electrical power cord.

BACKGROUND OF THE INVENTION

Electrical power cords are commonplace and are necessary in order to carry electrical energy from wall sockets (i.e., electrical outlets) to a multitude of common appliances, tools, etc. The electrical energy carried by such cords normally is 110 volts AC and is capable of inflicting serious injury or even death to a person who may come into direct electrical contact with such energy. For this reason, electrical cords are insulated.

However, conventional electrical power cords at one end must include outwardly extending prongs which slidably engage the energized electrical contacts in an electrical outlet when the prongs are inserted into the outlet. As soon as the prongs make electrical contact with the contacts in the outlet, electrical energy passes through the prongs and into the power cord. This happens even before the prongs are fully inserted into the electrical outlet.

Unfortunately, small children often place their fingers on the outwardly extending prongs of a power cord when attempting to insert the prongs into an electrical outlet. Consequently, small children can easily receive a strong electrical shock when attempting to insert the prongs into an electrical outlet.

There has not heretofore been provided a safety electrical plug having the advantages described herein for preventing children from attempting to connect a power cord to an electrical outlet.

SUMMARY OF THE INVENTION

In accordance with the present invention there is provided an electrical plug for attachment to one end of an electrical power cord having at least two electrical wires therein. The plug comprises:

(a) a body member having first and second ends;

(b) a plurality of spaced-apart plug prongs carried by the body member and being slidably movable between (i) a retracted position in which the prongs are within the body member; and (ii) an extended position in which the prongs project forwardly from the first end of the body member; wherein the prongs are electrically connected to the electrical wires in the body member;

(c) an arm attached to the prongs for slidable movement relative to the body member for movement of the prongs between the retracted and extended positions; and (d) lock means for locking the prongs selectively in the retracted position and the extended position, as desired.

When the electrical plug of this invention is operably connected to the end of an electrical power cord, the power cord is rendered much safer because the owner can retract the plug prongs into the plug and lock them when the cord is not being used. Then small children cannot be injured by attempting to insert the prongs into an electrical outlet.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
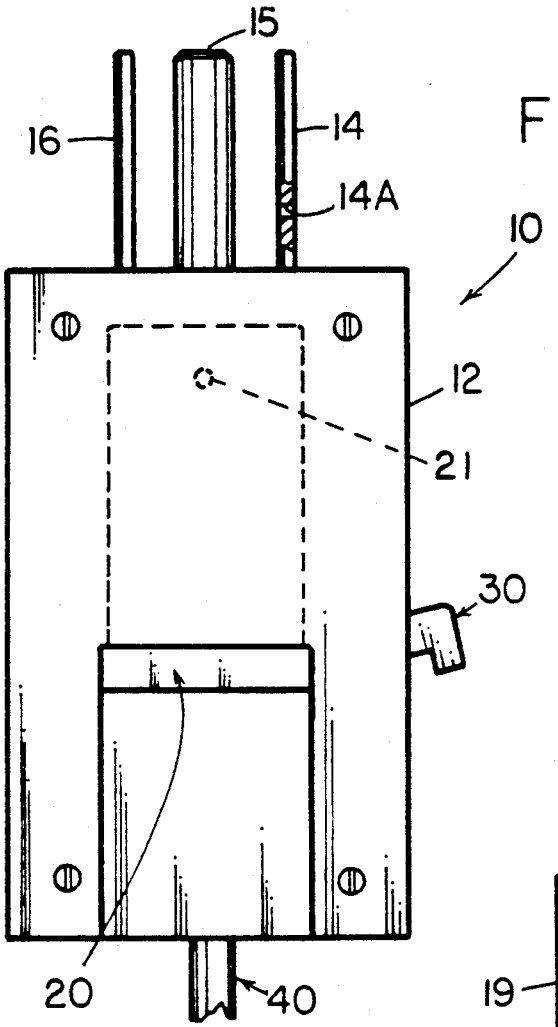
FIG. 1 is a top view of a safety plug of the invention.
Figure 2:
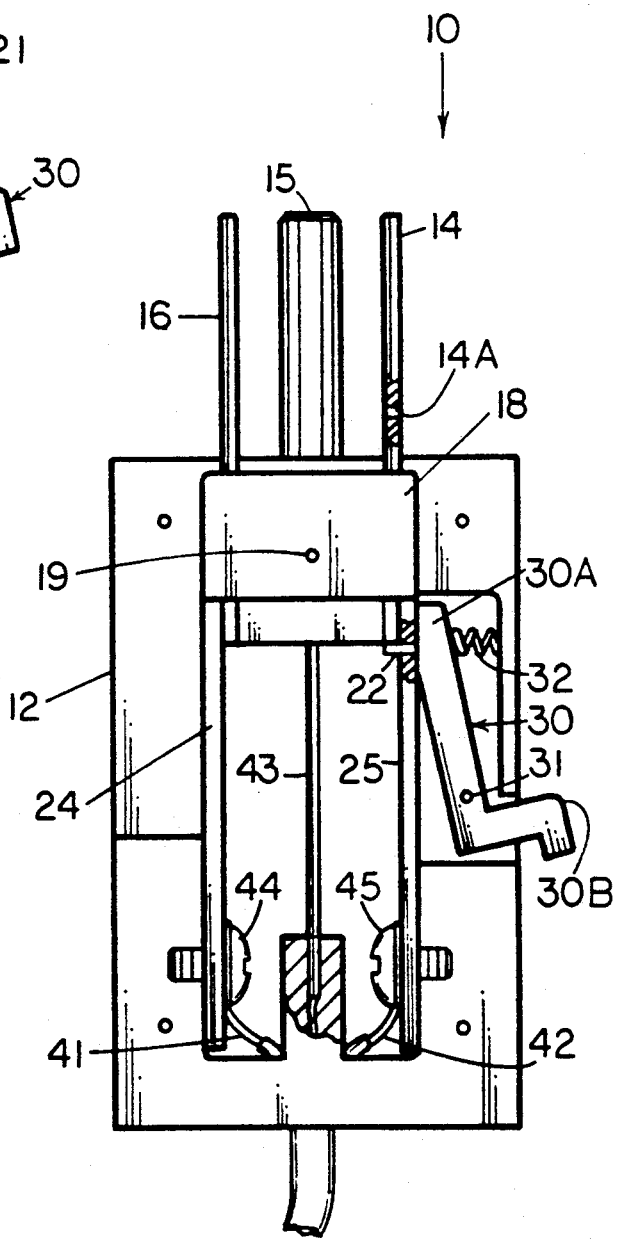
FIG. 2 is a cut-away view of the safety plug of FIG. 1.

In the drawings there is shown a safety plug 10 of the invention comprising a body member 12 for attachment to the end of an electrical power cord 40. In the power cord there are electrical wires 41, 42 and 43. Wire 41 is secured to prong recess guide 24 by screw 44, and wire 42 is secured to prong recess guide 25 by screw 45. Wire 43 is electrically connected to ground prong 15.

Spaced-apart prongs 14, 15 and 16 are slidably movable between an extended position (shown in the drawings) and a retracted position in which they are fully received within a cavity in the body member. Electrical energy from wires 41 and 42 travels to prongs 16 and 14, respectively, through guides 24 and 25. As shown in the drawings, prongs 14 and 16 are in sliding contact with the guides 24 and 25.

An arm 18 is secured to prongs 14, 15 and 16 so that movement of arm 18 along the longitudinal axis of the body member will cause the prongs to be moved selectively between their extended position and their retracted position. A slide button 20 is connected to arm 18 so that movement of arm 18 is controlled by the slide button. For example, an aperture 21 in the slide button may engage pin or post 19 on arm 18.

Locking means are included for locking the prongs in either the extended position or the retracted position, as desired. Pin 22 is secured to one end 30A of a pivotable lock arm or lever 30. The pin extends through an aperture or opening in the guide 25 as illustrated. Lever 30 is mounted on pin 31 to enable the lever to pivot. Spring or bias means 32 urges end 30A of the lever to the position shown in the drawings. By pushing end 30B of the lever toward the body 12 of the plug the pin 22 is caused to move away from the rearward end of prong 14. This enables the prongs to be retracted into the body member 12.

Prong 14 includes an aperture 14A. When the prongs are fully retracted into the body member, pin 22 can engage aperture 14A and thereby lock the prongs within body 12. The prongs can be unlocked by pressing end 30B of lock arm 30 again.

I claim:

1. An electrical plug for attachment to the end of an electrical power cord having at least two electrical wires therein, said plug comprising:

(a) a body member having first and second ends;

(b) a plurality of spaced-apart plug prongs carried by said body member and being slidably movable between (i) a retracted position in which said prongs are within said body member, and (ii) an extended position in which said prongs project forwardly from said first end of said body member; wherein said prongs are electrically connected to said electrical wires in said body member; wherein one of said prongs includes an aperture extending transversely therethrough;

(c) an arm attached to said prongs for slidable movement relative to said body member for movement of said prongs between said retracted and extended positions; and (d) lock means for locking said prongs selectively in said retracted position and in said extended position; wherein said lock means comprises a pin which is movable between inward and outward positions; wherein when said prongs are in said retracted position and said pin is in said inward position, said pin extends into said aperture and prevents said prongs from moving to said extended position.

2. An electrical plug in accordance with claim 1, further comprising a lock arm having first and second ends; wherein said lock arm is pivotably carried by said body member; wherein said pin is secured to said first end of said lock arm; and wherein said second end of said lock arm is accessible outside said body member for selective movement of said pin between said inward and outward positions.

3. An electrical plug in accordance with claim 2, further comprising bias means for biasing said lock arm in a manner such that said pin is in said inward position.

4. An electrical plug in accordance with claim 3, wherein said bias means comprises a spring.

5. An electrical plug in accordance with claim 1, wherein when said prongs are in said extended position and said pin is in said inward position, said pin is adapted to prevent said prongs from moving to said retracted position.

6. An electrical plug in accordance with claim 1, wherein there are three of said prongs.

* * * * *